United States Patent [19]

Barbe et al.

[11] 4,368,743

[45] Jan. 18, 1983

[54] METHOD AND MACHINE FOR TREATING UNITING BANDS IN FILTER TIPPING MACHINES OR THE LIKE

[75] Inventors: Karl-Heinz Barbe; Kurt Wamser, both of Hamburg, Fed. Rep. of Germany

[73] Assignee: Hauni-Werke Körber & Co. KG, Hamburg, Fed. Rep. of Germany

[21] Appl. No.: 234,455

[22] Filed: Feb. 17, 1981

[30] Foreign Application Priority Data

Feb. 21, 1980 [DE] Fed. Rep. of Germany ..... 3006510

[51] Int. Cl.[3] ..... A24C 5/47; A24C 5/56; A24C 5/58

[52] U.S. Cl. ..... 131/88; 131/68; 131/92; 131/94; 131/95

[58] Field of Search ..... 131/88, 95, 94, 68, 131/92

[56] References Cited

U.S. PATENT DOCUMENTS 4,282,889 8/1981 Dahlgrun ..... 131/95
4,291,713 9/1981 Frank ..... 131/68

*Primary Examiner*—V. Millin
*Attorney, Agent, or Firm*—Kontler, Grimes & Battersby

[57] ABSTRACT

One side of the web which is subdivided into uniting bands in a filter tipping machine is coated with a water-containing adhesive. A certain percentage of water is expelled from the adhesive prior to application of uniting bands to groups of coaxial plain cigarettes and filter plugs by a heating device whose heating action upon the adhesive on the web and/or uniting bands is regulatable in dependency on the speed of transport of the adhesive-coated web and/or uniting bands toward the location of attachment of uniting bands to the respective groups.

27 Claims, 6 Drawing Figures

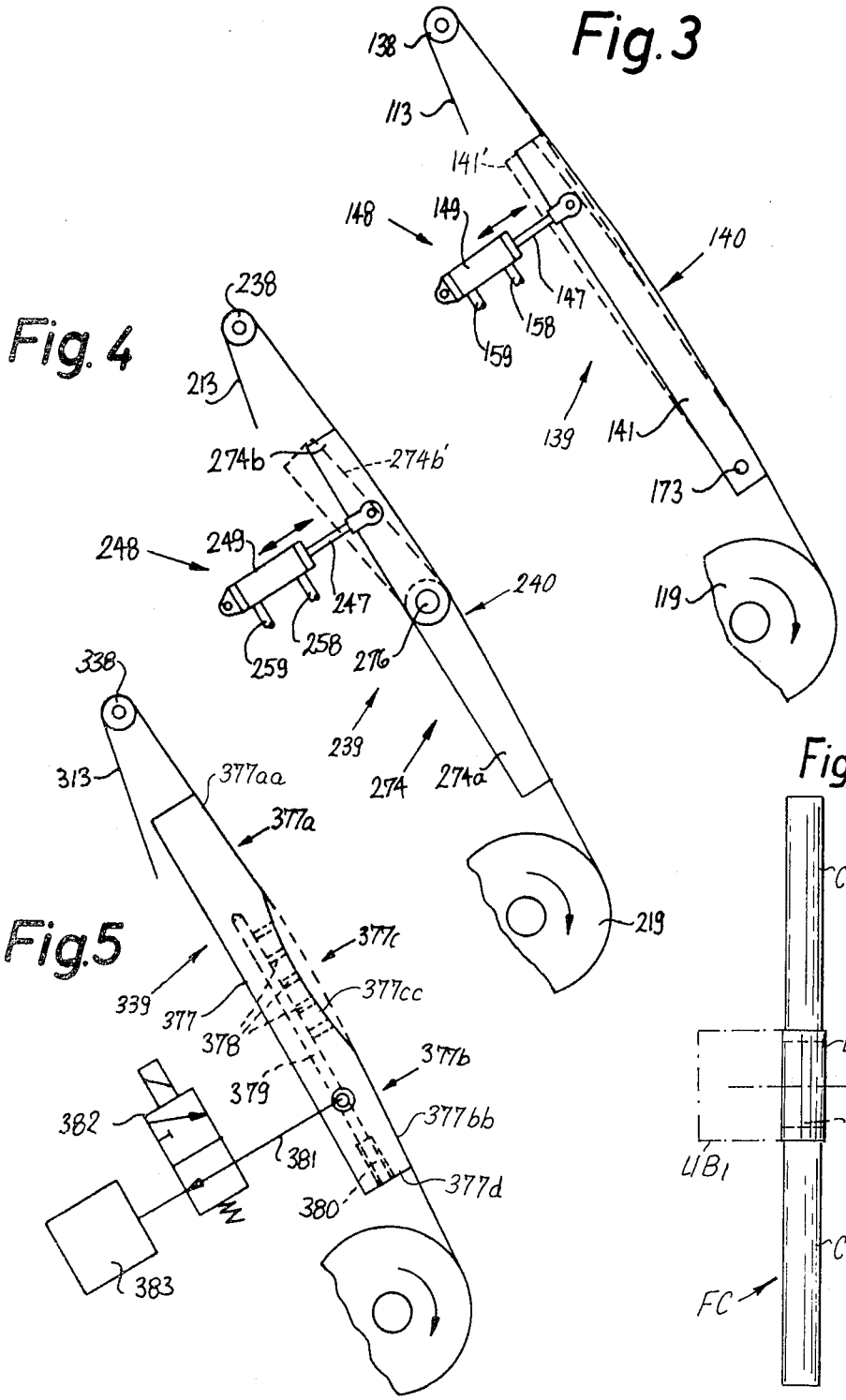
Fig. 3
138
113
141'
148
149
140
147
158
159
139
141
173
119
Fig. 4
238
213
274b
274b'
248
249
247
240
259
258
276
239
274
274a
219
Fig. 5
338
313
377aa
377a
377c
339
377
377cc
378
377b
379
382
377bb
381
377d
380
383
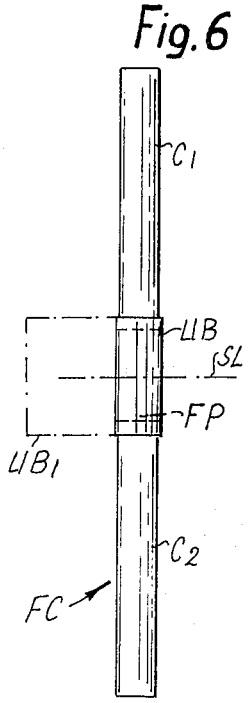
Fig. 6
C1
UB
SL
FP
UB1
C2
FC

METHOD AND MACHINE FOR TREATING UNITING BANDS IN FILTER TIPPING MACHINES OR THE LIKE

BACKGROUND OF THE INVENTION

The present invention relates to a method and to a machine for treating uniting bands which are used in filter tipping or like machines to connect rod-shaped articles end-to-end, especially to connect plain cigarettes with filter mouthpieces so as to form filter cigarettes of unit length or multiple unit length.

A filter tipping machine comprises means for subdividing an adhesive-coated web of uniting band material into discrete uniting bands which are thereupon rolled around the joints or points of abutment between plain cigarettes and aligned filter mouthpieces. In many instances, a group of coaxial rod-shaped articles which are to be joined by uniting bands consists of two spaced-apart plain cigarettes and a filter rod section of double unit length therebetween. A properly applied uniting band surrounds the filter rod section and the adjacent inner end portions of the plain cigarettés, and the resulting filter cigarette of double unit length is thereupon severed midway across the convoluted uniting band to yield two filter cigarettes of unit length.

As a rule, the adhesive which is applied to webs of uniting band material in a filter tipping machine (such webs normally consist of cigarette paper or imitation cork) is an aqueous dispersion of polyvinyl acetate glue. An important advantage of such glue is that it does not bind for a relatively long period of time subsequent to application to the web, and this is desirable in a filter tipping machine wherein the adhesive-coated web of uniting band material must be subdivided into discrete uniting bands, the bands attached to groups of coaxial rod-shaped articles and the groups transported to the wrapping or rolling station where the groups are rotated about their respective axes to thereby convolute the uniting bands therearound. The adhesive is applied by a paster which comprises one or more adhesive-applying rollers. A freshly applied uniting band extends substantially tangentially of the respective group of coaxial articles and is converted into a tube during rolling of the respective group in a gap whose width at most equals the diameter of the filter mouthpieces and/or plain cigarettes. The device which rolls the uniting bands around the respective groups of coaxial articles is heated to ensure rapid expulsion of water and attendant strengthening of the bond between the convoluted uniting band and the adjacent portions of the filter mouthpiece and plain cigarette or cigarettes.

The relatively long "open time" of adhesives which contain water or another evaporable liquid presents problems in connection with the processing of certain types of rod-shaped articles which constitute or form part of smokers' products. For example, aqueous dispersions of polyvinyl acetate glue are not satisfactory adhesives for attachment of uniting bands to unwrapped filter plugs, the so-called NWA filters, or for use in connection with highly porous wrapping materials. The main reason for development of problems in connection with the utilization of aforementioned types of adhesive as a means for attaching uniting bands to NWA filters is that the surfaces of such filters are fibrous and, therefore, an aqueous dispersion of polyvinyl acetate glue cannot establish an acceptable bond between such rough surfaces and the uniting bands. In other words, the force with which a wet adhesive of the just outlined character bonds the uniting band to an NWA filter is too weak to ensure adequate sealing action and/or retention of the uniting band in optimum position during transport toward and during treatment at the rolling or convoluting station of a filter tipping machine. If the uniting band material is overly porous, an aqueous dispersion of glue is likely to penetrate through the pores of uniting bands and to affect the appearance of the ultimate products as well as to bond the neighboring products to each other. Penetration of an aqueous dispersion of glue through a uniting band which consists of highly porous material is promoted by the long "open time" of such adhesives, i.e., by the fact that it takes the adhesive a relatively long time to set.

The aforementioned problems which arise in connection with the utilization of aqueous dispersions of glue can be avoided or solved by resorting to hotmelts. However, the cost of hotmelts is much higher for a number of reasons, especially because a hotmelt must be activated by heating prior to application to a web of uniting band material. Furthermore, and since the distance between the locus of application of adhesive in a filter tipping machine and the rolling or convoluting station is quite substantial, a hotmelt which has been heated in or in the region of the paster (i.e., at the locus of application of such heat-activatable adhesive to one side of a web of cigarette paper, artificial cork or a similar uniting band material) must be heated again prior to rolling of the uniting bands in order to ensure that each and every uniting band will form a tube which airtightly connects a filter plug to one or two plain cigarettes. Furthermore, and in order to guarantee rapid setting of hotmelt upon completion of the rolling operation, it is normally necessary to cool the convoluted uniting bands of freshly formed filter cigarettes. Heating of hotmelt in the region of the rolling or convoluting station as well as cooling of the freshly formed filter cigarettes presents problems in a filter tipping machine for a variety of reasons, not only as regards the space requirements but also in connection with the energy consumption, accessibility to the rolling station, likelihood of charring of the product at the rolling station and others.

OBJECTS AND SUMMARY OF THE INVENTION

An object of the invention is to provide a novel and improved method of treating flexible uniting band material in a filter tipping or like machine.

Another object of the invention is to provide a novel and improved method of enlarging the field of utilization of adhesives which constitute aqueous dispersions of polyvinyl acetate glue or the like.

A further object of the invention is to provide a novel and improved method of enlarging the field of use of wet adhesives in machines which serve for the manufacture and/or processing of rod-shaped smokers' products.

An additional object of the invention is to provide a method which renders it possible to use aqueous dispersions of a glue on uniting bands which are designed to connect plain cigarettes with so-called NWA filters or other types of filters which normally resist or do not promote adequate adherence of uniting bands bearing films of aqueous dispersions of a glue.

Still another object of the invention is to provide a method which renders it possible to utilize aqueous dispersions of a glue on uniting bands which consist of highly porous material.

A further object of the invention is to provide a method which renders it possible to produce highly satisfactory filter cigarettes by resorting to uniting bands which are coated with aqueous dispersions of a glue even if the material of the uniting bands and/or the nature of filter mouthpieces is such that the utilization of aqueous dispersions is expected to cause the making of an inferior product.

Another object of the invention is to provide a novel and improved machine for the practice of the above outlined method, especially a filter tipping machine which can be used to assemble NWA filters with plain cigarettes by resorting to uniting bands which are coated with wet glue or to assemble conventional filters (having discrete wrappers for filter material) with plain cigarettes or the like by resorting to highly porous uniting band material.

A further object of the invention is to provide the machine with novel and improved means for treating aqueous dispersions of polyvinyl acetate glue or the like prior to rolling of uniting bands around groups of coaxial filter mouthpieces and plain cigarettes or analogous tobacco-containing rod-shaped articles.

Another object of the invention is to provide a filter tipping machine with novel and improved means for treating the adhesive on uniting band material between the paster and the locus of attachment or rolling of uniting bands around groups of coaxial rod-shaped articles.

An ancillary object of the invention is to provide a filter tipping machine with novel and improved means for guiding the web of uniting band material between the paster and the locale of attachment of uniting bands to groups of coaxial cigarettes and filter mouthpieces.

A further object of the invention is to provide novel and improved means for regulating the percentage of liquid in a wet adhesive which is applied to one side of a web of uniting band material.

An additional object of the invention is to provide an attachment which can be utilized for the practice of the above outlined method and which can be installed in heretofore known filter tipping or analogous machines to enhance the versatility of such machines without adversely affecting the quality of the ultimate products.

Another object of the invention is to provide a filter tipping machine which can turn out superior filter cigarettes having NWA filters and convoluted uniting bands which adhere to NWA filters and plain cigarettes under the action of a wet adhesive, such as an adhesive which is applied to the web of uniting band material in the form of an aqueous dispersion.

One feature of the invention resides in the provision of a method of connecting rod-shaped smokers' products with rod-shaped filter plugs, especially of connecting plain cigarettes with filter mouthpieces. The method comprises the steps of assembling smokers' products and filter plugs into a series of groups of coaxial rod-shaped articles (each such group can consist of two plain cigarettes of unit length and a filter mouthpiece of double unit length therebetween), coating (at a first station) at least a portion of one side of a continuous web of wrapping material with a wet adhesive which contains an evaporable liquid (normally water), subdividing the thus coated web into a series of discrete uniting bands, applying successive uniting bands to successive groups of the aforementioned series of groups of coaxial articles at a second station, transporting the material of the web (i.e., the unsevered web and/or the uniting bands) between the first and second stations at a variable speed, and effecting evaporation of a predetermined percentage of liquid from the adhesive on the web or on the uniting bands intermediate the first and second stations. The evaporation effecting step includes supplying to the adhesive heat in quantites which vary as a function of changes in the speed of the material of the web between the first and second stations.

The heat supplying step preferably includes monitoring the speed of the material of the web between the first and second stations (i.e., subsequent to or even during the application of adhesive but not later than on attachment of uniting bands to the respective groups) and changing the quantity of supplied heat when the monitored speed deviates from a predetermined value. The changing step preferably includes increasing the quantity of supplied heat when the speed of the material of the web rises beyond the predetermined value and reducing the quantity of supplied heat when the speed of the material drops below the predetermined value.

The heat supplying step may include heating the material of the web.

The transporting step includes conveying the material of the web along an elongated path extending between the first and second stations, and the step of effecting evaporation of certain quantities of liquid can include supplying heat to the adhesive in a portion of the just mentioned path. The heat supplying step then includes varying the effective length of the aforementioned portion of the path in dependency on variations of the speed of the material of the web. This can be accomplished in a number of ways, e.g., by pivoting a heater relative to the web and/or by moving the web relative to the heater.

As explained above, the evaporation effecting step may include supplying heat to the web prior to the subdividing step, e.g., directly at the adhesive applying (first) station or between such station and the severing location intermediate the first and second stations.

If desired, the step of supplying heat can include varying the quantity of supplied heat in stepwise fashion in response to variations in the speed of the material of the web or continuously, i.e., the heating action can be subject to an infinite number of changes or to a limited number of changes.

Under certain circumstances, e.g., if the heat is radiated by one or more lamps, the heating action can take place between the severing location and the second station.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a similar front elevational view of a structure which constitutes a first modification of the structure shown in FIG. 2;

FIG. 4 is a similar front elevational view of a structure which constitutes a second modification of the structure shown in FIG. 2;

FIG. 5 is a similar front elevational view of a structure which constitutes a third modification of the structure shown in FIG. 2; and FIG. 6 is an elevational view of a filter cigarette of double unit length.

DESCRIPTION OF THE PREFERRED EMBODIMENTS

Figure 1:
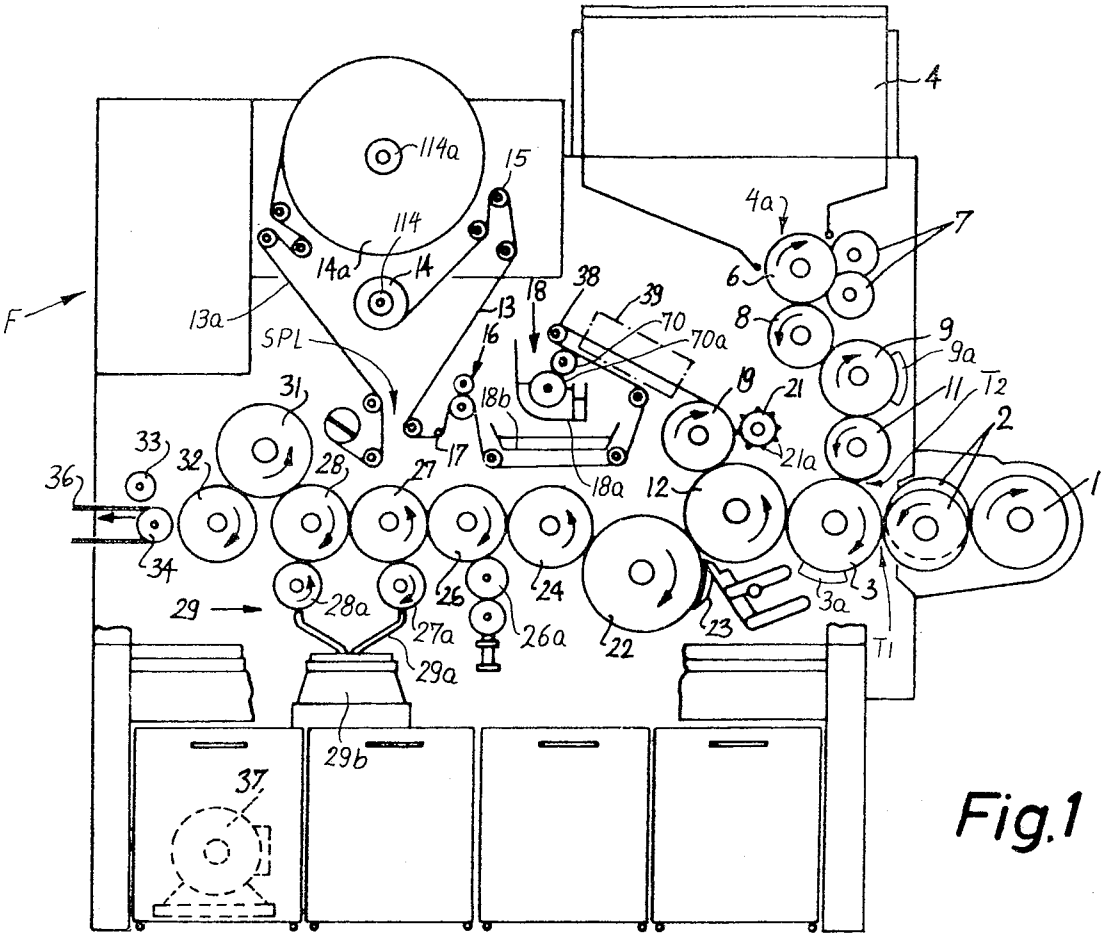
FIG. 1 is a schematic front elevational view of a filter tipping machine which embodies the present invention.

Referring first to FIG. 1, there is shown a filter tipping machine of the type known as MAX S which is manufactured and sold by the assignee of the present application. The construction of the filter tipping machine, which is directly coupled to a cigarette making machine (for example, a machine known as SE 80 manufactured and sold by the assignee of the present application) is as follows:

The frame F of the filter tipping machine supports a rotary drum-shaped conveyor 1 which can be said to form part of the aforementioned cigarette making machine and delivers two rows of plain cigarettes of unit length to a pair of staggered rotary drum-shaped aligning conveyors 2. The plain cigarettes of one row of cigarettes in the axially parallel peripheral flutes of the row forming conveyor 1 are adjacent to one axial end, and the plain cigarettes of the other row are adjacent to the other axial end of this conveyor. Furthermore, the cigarettes of one row are transported by oddly numbered flutes whereas the cigarettes of the other row are transported by the evenly numbered flutes of the conveyor 1. The two rows of cigarettes are transferred into the peripheral flutes of the corresponding aligning conveyors 2 which rotate in a counterclockwise direction, as viewed in FIG. 1, and are driven at different speeds and/or transport the respective cigarettes through different distances so that, when a flute of the front aligning conveyor 2, as viewed in FIG. 1, reaches a transfer station T1, it is an accurate axial alignment with a flute of the rear aligning conveyor 2. Such flutes deliver a pair of coaxial plain cigarettes of unit length into the adjacent flute of a rotary drum-shaped assembly conveyor 3 which is driven to rotate in a clockwise direction, as viewed in FIG. 1.

The top portion of the frame F supports a magazine 4 for a supply of parallel rod-shaped filter rod sections (not specifically shown) of six times unit length. The outlet opening 4*a* at the lower end of the magazine 4 receives a portion of a rotary drum-shaped severing conveyor 6 which is driven to rotate in a clockwise direction, as viewed in FIG. 1, and has peripheral flutes extending in parallelism with its axis. Such flutes remove discrete filter rod sections of six times unit length from the magazine 4 and transport successive filter rod sections past two rotary disc-shaped knives 7 which rotate about parallel axes and are staggered with respect to each other, as considered in the axial direction of the severing conveyor 6. The conveyor 6 cooperates with the knives 7 to convert successive filter rod sections of six times unit length into sets of three coaxial filter plugs of double unit length, and the filter plugs of successive sets are transferred onto a rotary staggering conveyor 8. The conveyor 8 is assembled of three discs which may but need not rotate about a common axis and are driven at different speeds and/or transport the respective filter plugs through different distances so that the filter plugs of each set are staggered with respect to each other, as considered in the circumferential direction of the conveyor 8, prior to transfer of successive filter plugs of double unit length into successive peripheral flutes of a rotary drum-shaped shuffling conveyor 9. The conveyor 9 is driven to rotate in a clockwise direction, as viewed in FIG. 1, and cooperates with two stationary cams 9*a* (only one shown) to convert the single row of axially staggered filter plugs into a row wherein each preceding filter plug is in accurate alignment with the next-following plug prior to transfer of successive plugs of the thus obtained row into successive flutes of a combined accelerating and inserting conveyor 11. The conveyor 11 is a rotary drum whose flutes deliver filter plugs of double unit length into successive flutes of the assembly conveyor 3 at a second transfer station $T_2$ which is located upstream of the transfer station $T_1$. The pairs of plain cigarettes of unit length which are delivered into the flutes of the assembly conveyor 3 at the transfer station $T_1$ are spaced apart from each other by a distance which at least equals the axial length of a filter plug of double unit length, and the inserting conveyor 11 delivers filter plugs into successive flutes at the station $T_2$ in such positions that, upon arrival at the transfer station $T_1$, the filter plugs are located in the gaps between the corresponding plain cigarettes of unit length. The assembly conveyor 3 advances the thus obtained groups of three coaxial rod-shaped articles each through the space between two suitably configurated condensing cams 3*a* (only one shown) which cause the plain cigarettes to move axially toward each other and into abutment with the respective end faces of the corresponding filter plug of double unit length.

The assembly conveyor 3 delivers successive condensed groups (each such group contains two coaxial plain cigarettes of unit length and a filter plug of double unit length therebetween) into successive flutes of a rotary drum-shaped transfer conveyor 12. This conveyor further receives adhesive-coated uniting bands from a rotary drum-shaped suction conveyor 19 which cooperates with the blades 21*a* of a rotary cutter 21.

The uniting bands are obtained in response to severing of the leader of a continuous web 13 of cigarette paper, imitation cork or another suitable flexible strip-shaped wrapping material. Such material is drawn off a reel 14 which is mounted on a spindle 114 and is caused to travel around a plurality of guide rolls 15 prior to reaching a so-called curling device 17 of the type disclosed in commonly owned U.S. Pat. No. 3,962,957 granted June 15, 1976 to Alfred Hinzmann. After advancing beyond the curling device 17, successive increments of the web 13 enter the nip of two advancing rolls 16 at least one of which is driven to advance the web in a direction toward a deflecting roll 38. The leader of the web 13 adheres to the foraminous peripheral surface of the rotary suction conveyor 19 and is caused to advance past successive blades 21*a* of the rotating cutter 21. The latter cooperates with the conveyor 19 to convert the web 13 into a series of discrete web portions or uniting bands of predetermined length. The conveyor 19 draws the web 13 from the deflecting roll 38 and transports the web past an adjustable heating device 39 which is constructed and assembled in accordance with one embodiment of the present invention. The roll 38 is located immediately downstream of the roller-shaped applicator 70 of a paster 18 which coats one side of the web 13 with a wet adhesive. The roll 70 receives adhesive from a source of supply here shown as a tank 18*a* by way of a withdrawing roll 70*a* and coats a portion of or the entire underside of the travelling web 13. A trough 18*b* which intercepts droplets of adhesive is disposed between the tank 18*a* and the heating device 39.

The conveyor 19 applies successive discrete uniting bands to successive groups of coaxial rod-shaped articles in the oncoming flutes of the transfer conveyor 12. The uniting bands are preferably applied in such a way that they are disposed substantially tangentially of the respective groups and adhere to the corresponding filter plugs as well as to the innermost portions of the respective plain cigarettes of unit length. Such groups, each of which carries an adhesive-coated uniting band, are thereupon transferred onto the peripheral surface of a rotary drum-shaped wrapping conveyor 22 which cooperates with an adjustable (stationary or mobile) rolling device 23 to convolute the oncoming uniting bands around the respective groups so that each group constitutes a filter cigarette of double unit length.

The wrapping conveyor 22 delivers successive filter cigarettes of double unit length into successive flutes of a rotary drum-shaped drying conveyor 24 which can embody or is associated with suitable testing means for detection of filter cigarettes having defective wrappers. At least those filter cigarettes of double unit length whose wrappers are satisfactory are thereupon delivered into successive flutes of a rotary drum-shaped severing conveyor 26 which cooperates with a rotary disk-shaped knife 26*a* to sever each filter cigarette of double unit length midway across its filter plug so that each such cigarette yields two coaxial filter cigarettes of unit length. Each filter cigarette of unit length contains a plain cigarette of unit length, a filter plug of unit length, and one-half of a convoluted tubular uniting band which binds the filter plug to the respective plain cigarette.

The severing conveyor 26 delivers successive pairs of filter cigarettes of unit length into successive flutes of a rotary drum-shaped conveyor 27 of a turn-around device 29 of the type disclosed in commonly owned U.S. Pat. No. 3,583,546 granted to Gerhard Koop. The turn-around device 29 further comprises a second rotary drum-shaped fluted conveyor 27*a* which receives one filter cigarette of each pair from the conveyor 27, a third rotary drum-shaped fluted conveyor 28 which receives the other filter cigarette of each pair from the conveyor 27, a fourth rotary drum-shaped fluted conveyor 28*a*, and a set of orbiting arms 29*a* which receive motion from a driving unit 29*b*.

The operation of the turn-around device 29 is as follows: The conveyor 27 receives pairs of coaxial filter cigarettes of unit length from successive flutes of the severing conveyor 26. One filter cigarette of each pair is delivered into the oncoming flute of the conveyor 28, whereas the other filter cigarette of each pair enters the oncoming flute of the conveyor 27*a*. Successive flutes of the conveyor 27*a* deliver the respective filter cigarettes of unit length to oncoming arms 29*a* which turn each filter cigarette end-for-end and deliver the inverted cigarettes into successive flutes of the conveyor 28*a*. The conveyor 28*a* delivers the inverted filter cigarettes of unit length into alternate flutes of the conveyor 28. It is to be noted that the conveyor 27 delivers successive non-inverted filter cigarettes of unit length into alternate flutes of the conveyor 28 so that the latter provides room for acceptance of inverted cigarettes from the conveyor 28*a*. The arrangement is preferably such that the conveyor 28*a* delivers inverted filter cigarettes of unit length into the spaces between successive pairs of non-inverted cigarettes on the conveyor 28. Thus, the conveyor 28 transports a single file of aligned filter cigarettes of unit length in a clockwise direction, as viewed in FIG. 1, and the filter plugs of all filter cigarettes on the conveyor 28 face the same direction. Successive flutes of the conveyor 28 deliver successive filter cigarettes of unit length to a testing conveyor 31, for example, of the type disclosed in commonly owned U.S. Pat. No. 3,962,906 granted June 15, 1976 to Uwe Heitmann et al. The cigarettes which are defective are segregated from satisfactory cigarettes on a rotary drum-shaped conveyor 32 which follows the testing conveyor 31 and may cooperate with an additional testing device which monitors the tobacco-containing ends of successive cigarettes. The cigarettes which are found to be defective by the testing unit including the conveyor 31 and/or by the testing unit including the conveyor 32 are segregated during travel past an ejecting device (not shown) of any known design and the remaining (satisfactory) cigarettes of unit length are delivered onto the upper reach of an endless belt conveyor 36. The upper reach of the conveyor 36 cooperates with a braking roll 33 and this conveyor is trained over pulleys 34 of which only one is shown in FIG. 1. The upper reach of the conveyor 36 delivers satisfactory filter cigarettes of unit length into storage, directly to a packing machine, or into a reservoir system (e.g., a system of the type which is known as Resy and is manufactured and sold by the assignee of the present application).

The operation of the wrapping conveyor 22 and rolling device 23 will be understood upon perusal of the disclosure in commonly owned U.S. Pat. Nos. 3,483,873 or 3,527,234, both granted to Alfred Hinzmann.

The frame F further supports a spindle 114*a* for a fresh reel 14*a* of wrapping material 13*a* the leader of which is held at a splicing station SPL. When the supply of running web 13 on the reel 14 is nearly exhausted, a splicing device (not specifically shown) at the station SPL is actuated to attach the leader of the web 13*a* to the trailing portion of the web 13. A splicing device which can be used in the filter tipping machine of FIG. 1 is disclosed, for example, in commonly owned U.S. Pat. No. 3,730,811 granted May 1, 1973 to Hans-Joachim Wendt. The disclosure of all of the aforementioned commonly owned patents are incorporated herein by reference.

The driven parts of the filter tipping machine receive motion from a main prime mover 37, e.g., a variable speed electric motor which can rotate the advancing rolls 16 and the suction conveyor 19 (i.e., the means for transporting the web 13 along an elongated path extending from the reel 14 to the transfer conveyor 12, namely, to the path for the groups of rod-shaped articles) at a plurality of different speeds.

Figure 2:
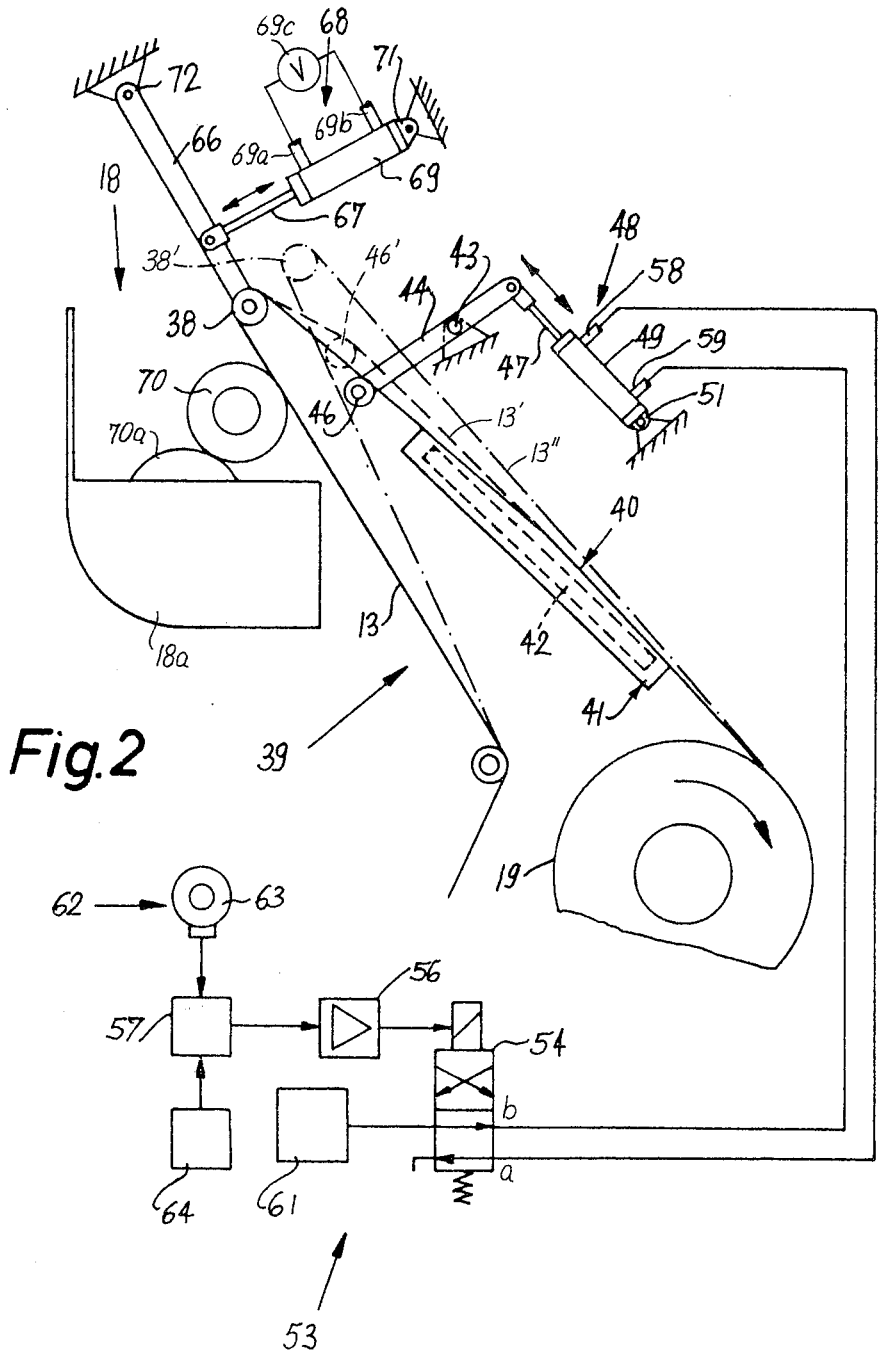
FIG. 2 is a greatly enlarged front elevational view of a detail in the machine of FIG. 1, showing one form of means for varying the quantities of admitted heat to successive increments of the adhesive layer or layers on the running web of uniting band material.

The paster 18 is installed in the frame F at a level below the deflecting roll 38 which normally causes one side of the running web 13 to contact the periphery of the roller-shaped applicator 70 (see also FIG. 2) of the paster 18 so that such side of the web 13 is at least partially coated with adhesive a supply of which is stored in the tank 18*a* of the paster 18. The adhesive is assumed to be an aqueous dispersion of polyvinyl acetate glue. The heating device 39 is disposed between the station which accommodates the paster 18 and the station (the transfer conveyor 12) where the suction conveyor 19 attaches discrete uniting bands to successive groups of rod-shaped articles. More particularly, the heating device 39 is installed in the frame F between the deflecting roll 38 and the suction conveyor 19, and the details of this heating device are shown in FIG. 2.

The purpose of the adjustable heating device 39 is to cooperate with a control unit 53 so as to effect evaporation of controlled quantities of water from the dispersion which is applied to one side of the web 13 during travel of successive increments of the web past the applicator 70 of the paster 18. This heating device comprises a guide 41 which is adjacent to the path of movement of the web 13 from the deflecting roll 38 toward the suction conveyor 19 and has an elongated convex guide surface 40 which is in contact with the uncoated (dry) side of the running web 13 when the filter tipping machine is in use. The guide 41 is heated by an electric heater, e.g., a heating cartridge 42 which is removably installed in an internal chamber of the guide 41 and serves to maintain the surface 40 at a preselected temperature at which the guide 41 expels a predetermined percentage of water from each increment of the adhesive film on the running web 13 so that the tackiness of the adhesive film is more pronounced when the corresponding increments reach the peripheral surface of the suction conveyor 19 (it will be noted that the suction conveyor 19 also contacts the uncoated side of the web 13). The web 13 contacts the entire surface 40 of the guide 41 when the filter tipping machine of FIG. 1 is operated at the normal speed, i.e., at a relatively high speed at which the speed of lengthwise movement of the web 13 is maintained at a maximum value. Therefore, the heated guide 41 causes expulsion of a given percentage of liquid from each and every unit length of the adhesive film at the upper side of the web portion which contacts the guide surface 40. If the speed of lengthwise movement of the web 13 is reduced, continued contact between the web and the entire guide surface 40 would entail the expulsion of excessive quantities of water from successive unit lengths of adhesive film on the web. Therefore, the machine is equipped with means for changing the area of contact between the web 13 and the heating device 39 as soon as the speed of the web is reduced. To this end, the web 13 can be moved at right angles to the longitudinal direction of the guide surface 40 by an adjusting mechanism which serves to regulate the quantities of heat supplied to the web 13 per unit of time as a function of changes in the speed of the web, i.e., in dependency on changes in the speed of the prime mover 37 or a transmission which transmits motion from the output element of the prime mover 37 to the advancing rolls 16 and suction conveyor 19. The adjusting mechanism comprises a two-armed lever 44 which is pivotable on a horizontal pin 43 mounted in or on the frame F. The free end portion of the longer arm of the lever 44 carries a shifting roller 46 which is normally out of contact with the uncoated side of the web 13 ahead of the guide surface 40 or engages the web 13 in such a way (i.e., to such an extent) that it does not interfere with contact between the web 13 and the entire convex guide surface 40. The other or shorter arm of the two-armed lever 44 is articulately connected with the piston rod 47 of a double-acting fluid-operated cylinder and piston unit 48 which can be said to constitute a fluid-operated motor serving to pivot the lever 44 about the axis of the pivot pin 43. The cylinder 49 of the unit 48 is articulately connected with the frame F by a horizontal pivot pin 51 which is parallel to the pin 43. The cylinder 49 has two chambers (one above and the other below the piston which is connected to the inner end portion of the piston rod 47), and these chambers respectively receive pressurized fluid or discharge fluid by way of conduits 58, 59 which are connected to the ports a and b of a solenoid-operated valve 54. The motor 48 can be said to constitute a regulating part of the control unit 53 which latter further includes the aforementioned solenoid operated valve 54, a source 61 of pressurized fluid (e.g., and air compressor) connected with the valve 54, a monitoring device 62 (preferably including or constituting a tachometer generator 63) which generates signals denoting the speed of the prime mover 37 (i.e., the speed of lengthwise transport of the web 13 between the deflecting roll 38 and the suction conveyor 19), and a signal comparing stage 57 one input of which receives signals from the tachometer generator 63 and another input of which receives signals from a source 64 (e.g., an adjustable potentiometer) of reference signals. The output of the signal comparing stage 57 is connected with the solenoid of the electromagnetic valve 54 by way of an amplifier 56. The stage 57 transmits signals to the amplifier 56 when the intensity or another characteristic of the reference signal furnished by the source 64 deviates from the intensity or another characteristic of the signal applied by the tachometer generator 63, i.e., when the speed of the web 13 deviates from a preselected threshold value.

When the valve 54 connects the conduit 58 with the source 61 of pressurized fluid, the conduit 59 is connected with the atmosphere, and vice versa. As a rule, the signal comparing stage 57 is designed to transmit a signal to the amplifier 56 (such signal initiates energization of the solenoid of the valve 54) when the intensity of the signal supplied by the tachometer generator 63 is less than the intensity of the reference signal from the source 64.

The deflecting roll 38 is mounted at the free end of a one-armed lever 66 which is mounted for pivotal movement about the axis of a pin 72 secured to the frame F. A median portion of the lever 66 is articulately connected to the piston rod 67 of a second fluid-operated motor 68 whose cylinder 69 is articulately connected with the frame F by a further pivot pin 71. The conduits 69*a* and 69*b* of the cylinder 69 are connected with the source 61 or with another source of pressurized fluid by a further valve 69*c* which can be actuated in response to starting or stoppage of the prime mover 37 in a manner not specifically shown in the drawing. For example, the control panel of the filter tipping machine may include a knob or another suitable actuating element which is manipulated by the attendant to start or arrest the prime mover 37 and to simultaneously actuate the valve 69*c*. The valve 69*c* causes the piston rod 67 to maintain the lever 66 in the position which is shown in FIG. 2 when the prime mover 37 is on; the deflecting roll 38 then allows the running web 13 to contact the entire surface 40 of the heated guide 41 provided, of course, that the motor 48 maintains the two-armed lever 44 in the illustrated position.

The operation of the heating device 39 of FIG. 2 is as follows:

As long as the prime mover 37 drives the moving parts (including the advancing rolls 16 and the suction conveyor 19) of the filter tipping machine at a speed which at least equals or exceeds the speed denoted by the reference signal from the source 64, the output of the signal comparing stage 57 does not transmit a signal and the amplifier 56 fails to energize the solenoid of the valve 54. Therefore, the conduit 59 receives pressurized fluid from the source 61 and the conduit 58 communicates with the atmosphere via valve 54. The piston rod 47 of the motor 48 is held in the illustrated extended position and the shifting roller 46 does not prevent the running web 13 from contacting the entire surface 40 of the heated guide 41. The heating action of the cartridge 42 in the guide 41 is selected or adjusted in such a way that the contact between the running web 13 and the entire surface 40 results in evaporation of a predetermined quantity of water from the film of adhesive coating that side of the web 13 which faces away from the surface 40.

If the speed of the prime mover 37 is reduced for any one of a number of various reasons (e.g., during splicing of the trailing end of the running web 13 to the leader of the fresh web 13*a* by the splicing device at the station SPL), the intensity of the signal which is transmitted by the tachometer generator 63 changes and the output of the signal comparing stage 57 transmits a signal which causes the amplifier 56 to energize the solenoid of the valve 54. The position of valving element in the valve 54 is then changed so that the conduit 59 communicates with the atmosphere and the conduit 58 receives pressurized fluid from the source 61. Consequently, the piston in the cylinder 49 retracts the piston rod 47 and the shifting roller 46 is moved to the broken-line position 46' in which the running web 13 contacts only a certain portion (e.g., one-half) of the convex surface 40 on the guide 41. It will be noted that the effective length of contact between the guide 41 and the web 13 is reduced in response to a reduction of the speed of lengthwise movement of the web 13, i.e., in response to a reduction of the output of the filter tipping machine. This ensures that the quantity of water which is evaporated per unit length of the web 13 remains unchanged or substantially unchanged. The position of the web 13 with reference to the surface 40 of the guide 41 when the solenoid of the valve 54 is energized is indicated in FIG. 2 by a broken line, as at 13'. The just discussed mode of operation of the structure shown in FIG. 2 ensures that the rate of evaporation of water per unit length of the film of adhesive on the web 13 remains unchanged or nearly unchanged independently of changes in the speed of lengthwise movement of the web 13 relative to the heating device 39.

If the filter tipping machine is arrested, i.e., if the prime mover 37 is brought to a halt, the piston in the cylinder 69 of the motor 68 retracts the piston rod 67 whereby the deflecting roll 38 is moved to the phantom-line position 38' and the web portion between the roller 38 (in the position 38') and the suction conveyor 19 is moved to the phantom-line position 13'', i.e., the web is out of contact with the surface 40 of the guide 41. At the same time, the deflecting roll 38 (in the position 38') maintains the web 13 out of contact with the applicator 70 of the paster 18 so that the web portion which is adjacent to the paster 18 cannot be soaked with wet adhesive. Termination of contact between the surface 40 and the web 13 on movement of the deflecting roll 38 to the position 38' ensures that the web 13 cannot be charred when the prime mover 37 is arrested.

It is clear that the control unit 53 of FIG. 53 can be modified in a number of ways without departing from the spirit of the invention. For example, the tachometer generator 63 can be designed to transmit signals to a stepping motor (not shown) which can move the shifting roller 46 to any desired number of positions each of which corresponds to a different area of contact between the web 13 and the heated convex surface 40, i.e., to a different effective length of the heating zone for the web 13. It is further possible to provide means for infinitely varying the position of the shifting roller 46 in dependency on corresponding changes in the speed of the web 13 relative to the stationary guide 41.

FIG. 3 shows a modification of the heating device 39 of FIG. 2. All such parts of the structure of FIG. 3 which are identical with or clearly analogous to corresponding parts of the structure shown in FIG. 2 are denoted by similar reference characters plus 100. The paper guide 141 of the heating device 139 is elongated and one of its end portions is pivotable about the axis of a pivot member 173 mounted in the frame of the filter tipping machine. The piston rod 147 of a fluid-operated shifting motor 148 is articulately connected to or close to the other end portion of the guide 141. When the speed of the web 113 is reduced, the piston rod 147 is retracted into the cylinder 149 in response to admission of pressurized fluid via conduit 158 whereby the guide 141 moves to the broken-line position 141' and the web 113 contacts a smaller portion of the elongated surface 140, i.e., the effective length of the heating zone for the web 113 is reduced as a function of a reduction of speed of the web. The surface 140 is convex or consists of two or more straight portions which are mutually inclined in such a way that the number of portions which contact the web 113 varies in response to pivoting of the guide 141 about the axis of the pivot member 173.

FIG. 4 illustrates a modified heating device 239. All such parts of the structure of FIG. 4 which are identical with or clearly analogous to those shown in FIG. 2 are denoted by similar reference characters plus 200. The guide 274 of the heating device 239 shown in FIG. 4 has a first portion 274*a* which is fixedly mounted in the frame of the filter tipping machine and a second portion 274*b* which is pivotable with respect to the portion 274*a* about the axis of a horizontal pivot member 276. The surface 240 of the guide 274 has two elongated parts which are respectively provided on the portions 274*a* and 274*b*. The web 213 contacts the entire surface 240 when the speed of its lengthwise movement is normal, i.e., when it matches the speed selected by the source of reference signals (not shown in FIG. 4 but corresponding to the source 64 shown in FIG. 2), and the web 213 contacts only the surface part on the portion 274*a* of the guide 274 when the speed of the web 213 is reduced below a given reference value. To this end, the portion 274*b* of the guide 241 is pivotable by a fluid-operated shifting motor 248 whose piston rod 247 is articulately connected to an intermediate part of the portion 274*b*. The inoperative position of the portion 274*b* (when the piston rod 247 is retracted into the cylinder 249 in response to admission of pressurized fluid via conduit 258 while the conduit 259 communicates with the atmosphere) is indicated by broken lines, as at 274*b'*.

FIG. 5 illustrates a further embodiment wherein all such parts which are identical with or clearly analogous to those shown in FIG. 1 or 2 are denoted by similar reference characters plus 300. The stationary web guide 377 of FIG. 5 is fixedly mounted in the frame of the filter tipping machine and includes three sections including two outer sections 377*a*, 377*b* and an intermediate section 377*c*. The sections 377*a* and 377*b* have convex or flat web-contacting surfaces 377*aa* and 377*bb*, and the intermediate section 377*c* has a concave web-contacting surface 377*cc*. The guide 377 has an elongated channel 379 one end of which is sealed by a plug 380 at the downstream end face 377*d* of the guide and which communicates with several suction ports 378 extending to the concave surface 377*cc*. The channel 379 is normally connected to a suction generating device 383 by way of a conduit 381 containing a solenoid-operated valve 382. When the web 313 is transported at normal speed, the valve 382 connects the suction generating device 383 with the channel 379 so that the pressure in the ports 378 is below atmospheric pressure and the web 313 is attracted to the concave surface 377*cc*, i.e., the web contacts the entire surface of the guide 377. When the speed of the web 313 is reduced below a preselected value, the solenoid of the valve 382 receives a signal to change the position of the valving element in the valve 382 so that the channel 379 communicates with the atmosphere and the ports 378 cease to attract the adjacent portion of the running web 313 to the concave surface 377*cc*. Therefore, the overall area of contact between the web 313 and the heated guide 377 is reduced as a function of reduction of the speed of lengthwise movement of the web.

An important advantage of the improved method and machine is that the adhesive on the web and/or on the uniting bands is subjected to a preliminary drying action with the result that a certain percentage of water is evaporated before the uniting bands are caused to contact the respective groups of coaxial rod-shaped articles. Therefore, the tackiness of adhesive films on the uniting bands is superior to that of films in conventional machines which employ aqueous dispersions of polyvinyl acetate glue or similar wet adhesives. It has been found that, when treated in accordance with the method of the present invention, a wet adhesive is not likely to penetrate through the pores of a highly porous web and also that the force of the film of glue on uniting bands is amply sufficient to ensure proper adherence of such bands to the external surfaces of co-called NWA filters. Since the percentage of evaporated liquid is constant or practically constant regardless of changes in the speed of lengthwise movement of the web, the machine is not likely to char the web at relatively low speeds of the web and the adhesive force of the film of glue on the uniting bands is constant or practically constant in spite of the fact that the machine can be operated at any one of two or more different speeds.

As already explained hereinabove, it is not absolutely necessary to change the heating action upon the web and/or uniting bands in exact conformity with each and every change in speed of lengthwise movement of the web, i.e., in conformity with each and every change in operating speed of the filter tipping machine. In many instances, and as described in connection with FIGS. 2 to 5, it suffices to increase the quantity of supplied heat per unit of time when the speed of lengthwise movement of the web is increased above a predetermined threshold value and to reduce the quantity of heat when such speed drops below the threshold value. FIGS. 2–5 illustrate four embodiments of the presently preferred equipment for expulsion of predetermined or given quantities of liquid from the adhesive films, namely, by heating the web prior to subdivision of the web into discrete uniting bands. Though it is also possible to employ a control system which regulates the heating action of the heating means (cartridge or cartridges) for the guide along which the web 13, 113, 213 or 313 advances whenever the speed of lengthwise movement of the web changes or in response to certain changes in such speed, the provision of means for changing the length or effective length of contact between the web and the guide is preferred because the quantity of heat which is supplied to the web (and hence to the adhesive film on the web) can be changed practically instantaneously whereas any adjustments of heating action of a cartridge in the guide would not entail immediate changes in the temperature of the guide.

An advantage of the guide 41 which is shown in FIG. 2 is that it is relatively simple (all that is necessary is to provide it with a convex surface 40 or a multi-facetted surface) because it need not be moved relative to the frame. The guide 377 of FIG. 5 is also stationary; however, the median portion 377*c* must be formed with suction ports and the composite surface 377*aa*, 377*cc*, 377*bb* is relatively complex. The effect of movement of the web relative to a stationary guide or the effect of movement of one or more portions of the guide relative to the web is the same, i.e., such movement (at right angles or substantially at right angles to the longitudinal direction of the guide or at right angles to the longitudinal direction of the web) entails a change in the quantity of heat which is supplied to the film of adhesive for the purpose of effecting evaporation of a given percentage of liquid before the uniting bands reach the oncoming groups of coaxial rod-shaped articles.

The improved machine is susceptible of many further modifications. For example, the paper guide need not be heated if the hearting cartridge is replaced by a battery or row of lamps which radiate heat against the path of movement of the web and/or uniting bands in the region between the paster and the locus where the uniting bands are attached to successive groups of coaxial rod-shaped articles. The control means or adjusting means of such a machine comprises an arrangement for varying the number of heat-emitting lamps as a function of changes in speed of lengthwise movement of the running web. Alternatively, one or more lamps can be caused to change their orientation in response to a reduction of the speed of the web so that the number of lamps which direct heat against the adhesive film on the web is reduced in dependency on a reduction of the speed of the web. Furthermore, the control system for the just discussed lamps can include means for changing the voltage and/or amperage of electrical energy which is supplied to the lamps as a function of changes in the speed of the running web, i.e., the lamps need not be turned on or off and their orientation need not be changed but the control system merely changes the intensity of heat energy which is radiated by the lamps at different speeds of the web.

It is equally within the purview of the invention to resort to hot air which is directed against the film of wet adhesive on the running web to effect a preliminary drying of such adhesive (i.e., to effect evaporation of a predetermined percentage of liquid) between the station for the paster and the station where the uniting bands are attached to groups of rod-shaped articles. The control system for use in a machine which operates with hot air then comprises suitable means for varying the quantity of hot air which impinges upon each unit length of the running web per unit of time in dependency on changes in the speed of lengthwise movement of the web. An advantage of the methods which resort to radiation heat (one or more lamps) and/or hot air or another heated gas is that such heat or hot gas can be directed against the individual uniting bands, i.e., it is not absolutely necessary to heat the adhesive on the web ahead of the severing means such as the severing means including the components 19 and 21 of FIG. 1.

FIG. 6 illustrates a filter cigarette FC of double unit length. This cigarette consists of a group of three coaxial rod-shaped articles including two plain cigarettes $C_1$ and $C_2$ of unit length and a filter plug FP of double unit length therebetween, and a convoluted uniting band UB which forms a tube around the filter plug FP and the adjacent inner end portions of the plain cigarettes $C_1$ and $C_2$. The reference character $UB_1$ denotes the position of the uniting band prior to conversion into a tube, i.e., the position of the uniting band relative to a group of three coaxial articles $C_1$, FP and $C_2$ on the transfer conveyor 12 of FIG. 1. The phantom line SL denotes the plane in which the knife 26*a* of FIG. 1 severs the filter cigarette FC of FIG. 6 so that the latter yields two filter cigarettes of unit length. Each filter cigarette of unit length consists of one of the plain cigarettes $C_1$ and $C_2$, one-half of the filter plug FP, and one-half of the convoluted uniting band UB.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of connecting rod-shaped smokers' products with rod-shaped filter plugs, especially for connecting cigarettes with filter mouthpieces, comprising the steps of assembling smoker's products and filter plugs into a series of groups of coaxial rod-shaped articles; coating, at a first station, at least a portion of one side of a continuous web of wrapping material with a web adhesive which contains an evaporable liquid; subdividing the coated web into a succession of discrete uniting bands; applying successive uniting bands to successive groups of said series at a second station; transporting the material of the web at a variable speed between said first and second stations; and effecting evaporation of a predetermined percentage of liquid from the adhesive on the material of the web between said first and second stations, including supplying to the adhesive heat in quantities varying as a function of changes in said speed.

2. The method of claim 1, wherein said liquid is water.

3. The method of claim 1, wherein said heat supplying step includes monitoring the speed of the material of the web between said stations and changing the quantity of supplied heat when the monitored speed deviates from a predetermined value.

4. The method of claim 3, wherein said changing step includes increasing the quantity of supplied heat when the speed of the material of the web rises beyond said predetermined value.

5. The method of claim 3, wherein said changing step includes reducing the quantity of supplied heat when the speed of the material of the web drops below said predetermined value.

6. The method of claim 1, wherein said heat supplying step includes heating the material of the web so that the heated material of the web heats the adhesive at the one side of the web.

7. The method of claim 1, wherein said transporting step includes conveying the material of the web along an elongated path extending between said first and second stations and said evaporation effecting step includes supplying heat to adhesive in a portion of said path, said heat supplying step including varying the effective length of said portion of said path in dependency on variations of said speed.

8. The method of claim 1, wherein said evaporation effecting step includes supplying heat to the web prior to said subdividing step.

9. The method of claim 1, wherein said heat supplying step includes varying the quantity of heat in stepwise fashion in response to variations of said speed.

10. The method of claim 1, wherein said heat supplying step is carried out in the region of one of said stations.

11. The method of claim 1, wherein said heat is radiation heat.

12. In a machine for connecting rod-shaped smokers' products with rod-shaped filter plugs, especially for connecting cigarettes with filter mouthpieces, the combination of means for assembling smokers' products and filter plugs into a series of groups of coaxial rod-shaped articles and for transporting the groups along a first path; a paster including a supply of wet adhesive which contains an evaporable liquid; a source of a web of uniting band material; means for advancing the web at a variable speed along a predetermined second path from said source and along said paster, so that at least a portion of one side of the running web is coated with adhesive, and toward said first path; severing means adjacent to said second path intermediate said paster and said first path and including means for subdividing the adhesive-coated web into discrete uniting bands which are applied to succesive groups of the series in said first path; and means for effecting evaporation of a predetermined percentage of liquid from the adhesive in said second path, including adjustable means for supplying heat to adhesive in said second path at a rate which varies as a function of changes in the speed of advancement of the material of the web along said second path, said heat supplying means being adjacent to said second path ahead of the locus of application of uniting bands to successive groups of the series in said first path.

13. The combination of claim 12, wherein said evaporation effecting means further comprises signal generating control means including signal generating means for monitoring the speed of the material of the web in said second path and means for adjusting said heat supplying means in response to signals from said monitoring means.

14. The combination of claim 13, wherein said control means further includes a source of reference signals denoting a given speed of the material of the web, means for comparing said reference signals with the signals from said monitoring means and for generating additional signals when the characteristics of signals furnished by said monitoring means deviate from the characteristics of said reference signals, and means for regulating the application of heat to adhesive in said second path in response to said additional signals.

15. The combination of claim 12, wherein said heat supplying means includes guide means for the material of the web in said second path.

16. In a machine for connecting rod-shaped smokers' products with rod-shaped filter plugs, especially for connecting cigarettes wigh filter mouthpieces, the combination of means for assembling smokers' products and filter plugs into a series of groups of coaxial rod-shaped articles and for transporting the groups along a first path; a paster including a supply of wet adhesive which contains an evaporable liquid; a source of a web of uniting band material; means for advancing the web at a variable speed along an elongated second path from said source and along said paster, so that at least a portion of one side of the running web is coated with adhesive, and toward said first path; severing means adjacent to said second path intermediate said paster and said first path and including means for subdividing the adhesive-coated web into discrete uniting bands which are applied to successive groups of the series in said first path; and means for effecting evaporation of a predetermined percentage of liquid from the adhesive in said second path, including adjustable means for supplying heat to adhesive in said second path at a rate which varies as a function of changes in the speed of advancement of the material of the web along said second path, said heat supplying means including guide means for the material of the web in said second path and said guide means including a convex surface which normally contacts the material of the web in said second path.

17. The combination of claim 16, wherein said evaporation effecting means further comprises control means including signal generating means for monitoring the speed of the material of the web in said second path and regulating means operatively connected to said monitoring means and including shifting means for changing the relative positions of the material of the web in said second path and said guide means in response to signals from said monitoring means.

18. The combination of claim 17, wherein said guide means includes an elongated guide surface for the material of the web and said shifting means includes means for effecting a relative movement between said guide means and the material of the web in said second path substantially at right angles to the longitudinal direction of said surface.

19. The combination of claim 17, wherein said shifting means includes means for moving the material of the web relative to said guide means.

20. The combination of claim 19, wherein said guide means includes an elongated surface which normally contacts the material of the web in said second path and said shifting means includes a device which is operative to change the area of contact between said surface and the material of the web.

21. The combination of claim 17, wherein said guide means is elongated and includes first and second end portions, and further comprising means for pivotally supporting said guide means in the region of one of said end portions, said shifting means including means for pivoting said guide means relative to the material of the web in said second path.

22. The combination of claim 21, wherein said guide means comprises two portions.

23. The combination of claim 17, wherein said shifting means includes a fluid-operated motor.

24. The combination of claim 17, wherein said guide means includes a plurality of portions and at least one of said portions is movable relative to another portion between first and second portions in which said one portion respectively contacts and is remote from the material of the web in said second path, said shifting means including means for moving said one portion relative to said other portion.

25. The combination of claim 17, wherein said guide means comprises a concave portion and means for normally maintaining the material of the web in said second path in contact with said concave portion, said shifting means including means for effecting disengagement of said concave portion from the material of the web in said path in response to a reduction of said speed.

26. The combination of claim 25, wherein said maintaining means includes means for attracting the material of the web to said concave portion by suction and said means for effecting disengagement includes means for deactivating said attracting means.

27. The combination of claim 26, wherein said deactivating means includes a valve.

* * * * *